US005214884A

United States Patent [19]

Kinoshita et al.

[11] Patent Number: 5,214,884

[45] Date of Patent: Jun. 1, 1993

[54] BALL POLISHING APPARATUS AND METHOD FOR THE SAME

[75] Inventors: Hidetoshi Kinoshita; Eiji Sato, both of Yokohama, Japan

[73] Assignee: Kabushiki Kaisha Toshiba, Kawasaki, Japan

[21] Appl. No.: 872,343

[22] Filed: Apr. 23, 1992

[30] Foreign Application Priority Data

| | | | |
|---|---|---|---|
| Apr. 23, 1991 | [JP] | Japan | 3-091860 |
| Jun. 27, 1991 | [JP] | Japan | 3-156445 |
| Dec. 18, 1991 | [JP] | Japan | 3-334966 |

[51] Int. Cl.[5] ..... B24B 1/00; B24B 5/36

[52] U.S. Cl. ..... 51/289 S; 51/118; 51/131.2; 51/131.4

[58] Field of Search ..... 51/109 R, 117, 118, 51/129, 131.1, 131.2, 131.4, 165.71, 165.8, 289 R, 289 S; 269/8

[56] References Cited

U.S. PATENT DOCUMENTS

| | | | |
|---|---|---|---|
| 3,791,083 | 2/1974 | Messerschmidt | 51/289 S |
| 3,984,945 | 10/1976 | Messerschmidt | 51/289 S |
| 4,771,578 | 9/1988 | Jorgensen | 51/118 |
| 4,916,868 | 4/1990 | Wittstock | 51/118 |

FOREIGN PATENT DOCUMENTS

| | | | |
|---|---|---|---|
| 0113301 | 7/1984 | European Pat. Off. | 269/8 |
| 81491 | 9/1894 | Fed. Rep. of Germany | 51/289 S |
| 57-84731 | 5/1982 | Japan . | |
| 57-121454 | 7/1982 | Japan . | |
| 59-14461 | 1/1984 | Japan . | |
| 59-215805 | 12/1984 | Japan . | |
| 0192471 | 8/1986 | Japan | 51/289 S |
| 3178771 | 8/1991 | Japan | 51/289 S |
| 0617245 | 7/1978 | U.S.S.R. | 51/289 R |
| 0663560 | 6/1979 | U.S.S.R. | 51/131.2 |
| 1404285 | 6/1988 | U.S.S.R. | 51/289 S |
| 1546237 | 2/1990 | U.S.S.R. | 51/289 S |

*Primary Examiner*—Bruce M. Kisliuk
*Assistant Examiner*—Bo Bounkong
*Attorney, Agent, or Firm*—Oblon, Spivak, McClelland, Maier & Neustadt

[57] ABSTRACT

A lower polishing disk is divided into inner and outer disks, and a holding portion for rollably holding a ball is formed with the outer circumferential portion of the inner disk and the inner circumferential portion of the outer polishing disk. The ball held by the holding portion is pushed by the upper polishing disk with a predetermined load. When the inner disk, outer disk, and upper polishing disk are driven in this state, the ball is polished.

15 Claims, 9 Drawing Sheets

BALL POLISHING APPARATUS AND METHOD FOR THE SAME

Background of the Invention

1. Field of the Invention

The present invention relates to a ball polishing apparatus for polishing a ball with high shape precision, and a method for the same.

2. Description of the Related Art

To polish a ball, a polishing apparatus as shown in FIG. 1 is conventionally used. Referring to FIG. 1, reference numeral 1 denotes a lower polishing disk which is driven to rotate. V-shaped grooves 3 for rotatably holding a multiple of balls 2, i.e., ceramic balls, as works are formed in the upper surface of the lower polishing disk 1 in the circumferential direction.

An upper polishing disk 4 which is driven to rotate in the opposite direction to that of the lower polishing disk 1 is provided on the upper surface side of the lower polishing disk 1. The upper and lower polishing disks 4 and 1 are rotated in the opposite directions while the upper polishing disk 4 is in tight contact with the balls 2 so as to serve as a predetermined load. Then, each ball 2 is rotated about its axis and an axis of each disk so as to be polished by polishing grains which are externally supplied.

Not only the sphericity but also the diameter of the plurality of balls 2 supplied to the V-shaped grooves 3 of the lower disk 1 during one polishing, i.e., the balls 2 of one lot vary (the variation in diameter is called size variation). Thus, when the polishing disks 1 and 4 are rotated while the balls 2 are pushed with a predetermined pressure by the upper polishing disk 4, the pressure applied on each ball 2 becomes momentarily excessive or insufficient due to the variation in sphericity or diameter of the ball 2.

When an abnormality occurs in the pressure in this manner, galling occurs between the lower polishing disk 1 and a ball 2, thus damaging the lower polishing disk 1 or failing to obtain a desired sphericity or size variation as the shape precision of the ball 2.

The size of a ball 2 which can be polished is determined by the size of the corresponding V-shaped groove 3 formed in the lower polishing disk 1. Thus, to polish balls 2 having a different size, the lower polishing disk 1 must be replaced with one in which V-shaped grooves 3 appropriate for the size of the new balls 2 are formed. However, it is not easy to replace the lower polishing disk 1, resulting in a cumbersome operation.

Summary of the Invention

It is an object of the present invention to provide a polishing apparatus which can polish works with high variation-free shape precision without causing galling between the works and the polishing disks even when the sizes of the works of one lot vary, and a method for the same.

According to one aspect of the present invention, there is provided a ball polishing apparatus for polishing a ball, comprising:

a lower polishing disk having an inner disk and an annular outer disk surrounding said inner disk and coaxial therewith, an outer circumferential portion of said inner disk and an inner circumferential portion of said outer polishing disk forming a holding portion for rollably holding the ball; magnetic holding means for holding said outer disk in a floating state by a magnetic force and in a predetermined positional relationship with said inner disk; first driving means for driving said inner disk; second driving means for driving said outer disk without impairing the floating state of said outer disk achieved by the magnetic force; an upper polishing disk opposing said lower polishing disk, for pushing the ball held by said holding portion; and third driving means for driving said upper polishing disk.

According to another aspect of the present invention, there is provided a ball polishing apparatus for polishing a ball, comprising:

a base; a rotary member constituting a cylindrical member and provided on said base to be rotatable about an axis of the cylindrical member; a lower polishing disk having a inner disk and an annular outer disk surrounding said inner disk and coaxial therewith, and provided in said rotary member, an outer circumferential portion of said inner disk and an inner circumferential portion of said outer disk, forming a holding portion for rollably holding the ball; magnetic holding means, provided at a base portion serving as an interior of said rotary member, for holding said outer disk in a floating state by a magnetic force and in a predetermined positional relationship with said inner disk; first driving means for driving said inner disk; magnetic coupling means, provided at an inner circumferential portion of said cylindrical member, for coupling said outer disk with said cylindrical member in a non-contact manner by a magnetic force; second driving means for integrally rotating said outer disk and said cylindrical member through said magnetic coupling means provided to said cylindrical member by driving said cylindrical member; an upper polishing disk opposing said lower polishing disk, for pushing the ball held by said holding portion; and third driving means for driving said upper polishing disk.

According to yet another aspect of the present invention, there is provided a polishing method of polishing a ball with upper and lower polishing disks, comprising the steps of:

holding an outer disk in a floating state by a magnetic force and in a predetermined positional relationship with an inner disk by using said lower polishing disk constituted by said inner disk and said annular outer disk surrounding said inner disk and coaxial therewith; supplying a ball to a holding portion formed by an outer circumferential portion of said inner disk and an inner circumferential portion of said outer disk; pushing the ball held by said holding portion by said upper polishing disk with a predetermined load; and driving said inner disk, outer disk, and upper polishing disk.

According to another aspect of the present invention, there is provided a ball polishing apparatus for polishing a ball, comprising:

at least two inner disks vertically spaced apart at a predetermined gap and opposing each other, each having a diameter greater than the immediate lower one; at least two of annular outer disks, having different diameters and surrounding said inner disks and coaxial therewith, respectively, forming holding portions for holding the ball with inner circumferential portions thereof and outer circumferential portions of said inner disk; magnetic holding means for holding said outer disks in a floating state by a magnetic force and in a predetermined positional relationships with said inner disks; and driving means for driving said inner and outer disks in predetermined directions, respectively.

According to yet another aspect of the invention, there is provided a ball polishing apparatus for polishing a ball, comprising:

a lower polishing disk, having an inner disk and an annular outer disk surrounding said inner disk and coaxial therewith, an outer circumferential portion of said inner disk and an inner circumferential portion of said outer disk forming a holding portion for rollably holding the ball; positioning means for moving at least one of said outer and inner disks to adjust a mutual positional relationship therebetween; first driving means for driving said lower polishing disk; an upper polishing disk, arranged and opposing said lower polishing disk, for pushing the ball held by said holding portion; and second driving means for driving said upper polishing disk.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

Brief Description of the Drawings

The accompanying drawings, which are incorporated in and constitute a part of the specification, illustrate presently preferred embodiments of the invention and, together with the general description given above and the detailed description of the preferred embodiments given below, serve to explain the principles of the invention.

Detailed Description of the Preferred Embodiments

The preferred embodiments of the present invention will be described with reference to the accompanying drawings.

Figure 1:
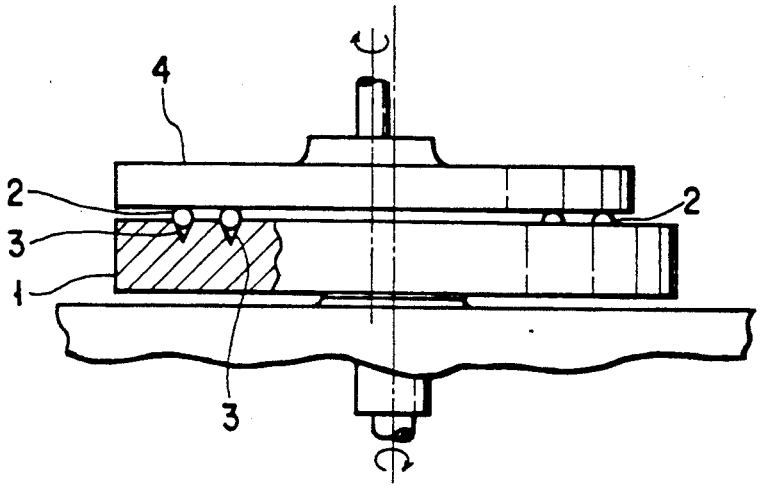
PRIOR ART FIG. 1
FIG. 1 shows the arrangement of a conventional polishing apparatus.
Figure 2:
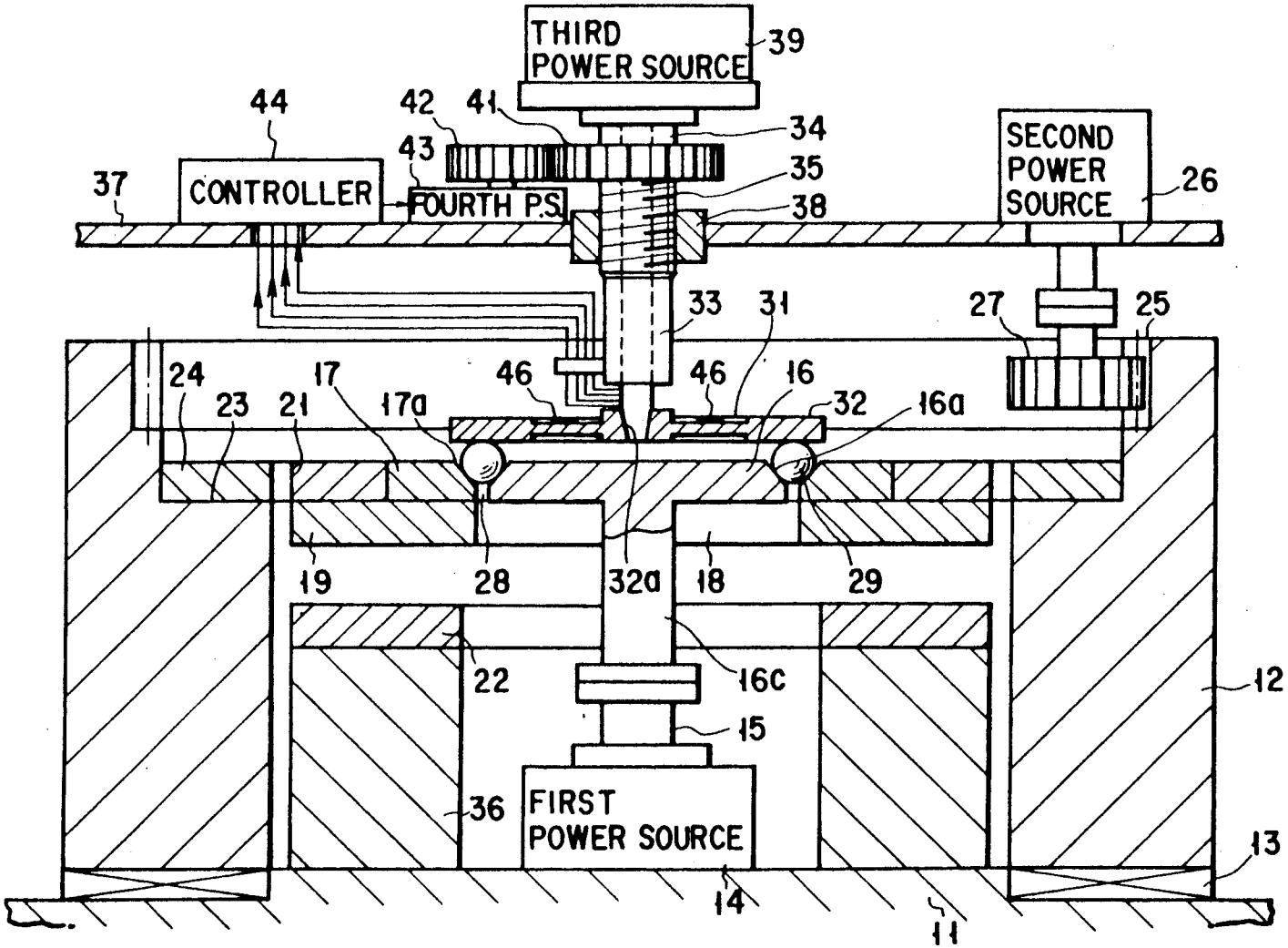
FIG. 2 is a sectional view showing the overall arrangement of a polishing apparatus according to the first embodiment of the present invention.

FIGS. 2 to 5 show a polishing apparatus according to the first embodiment of the present invention. Referring to FIG. 2, reference numeral 11 denotes a base. A cylindrical rotary member 12 is rotatably provided on the base 11 through a thrust bearing 13. A first power source 14 is provided in the rotary member 12. The axis of a driving shaft 15 of the first power source 14 coincides with the center of rotation of the rotary member 12.

A lower polishing disk 18 consists of an inner disk 16 and an annular outer disk 17. The power source 14 drives the inner disk 16 of the lower polishing disk 18. A shaft portion **16*c* is provided to extend from the lower surface of the inner disk 16 and coupled to the driving shaft 15 of the power source 14**.

Figure 3:
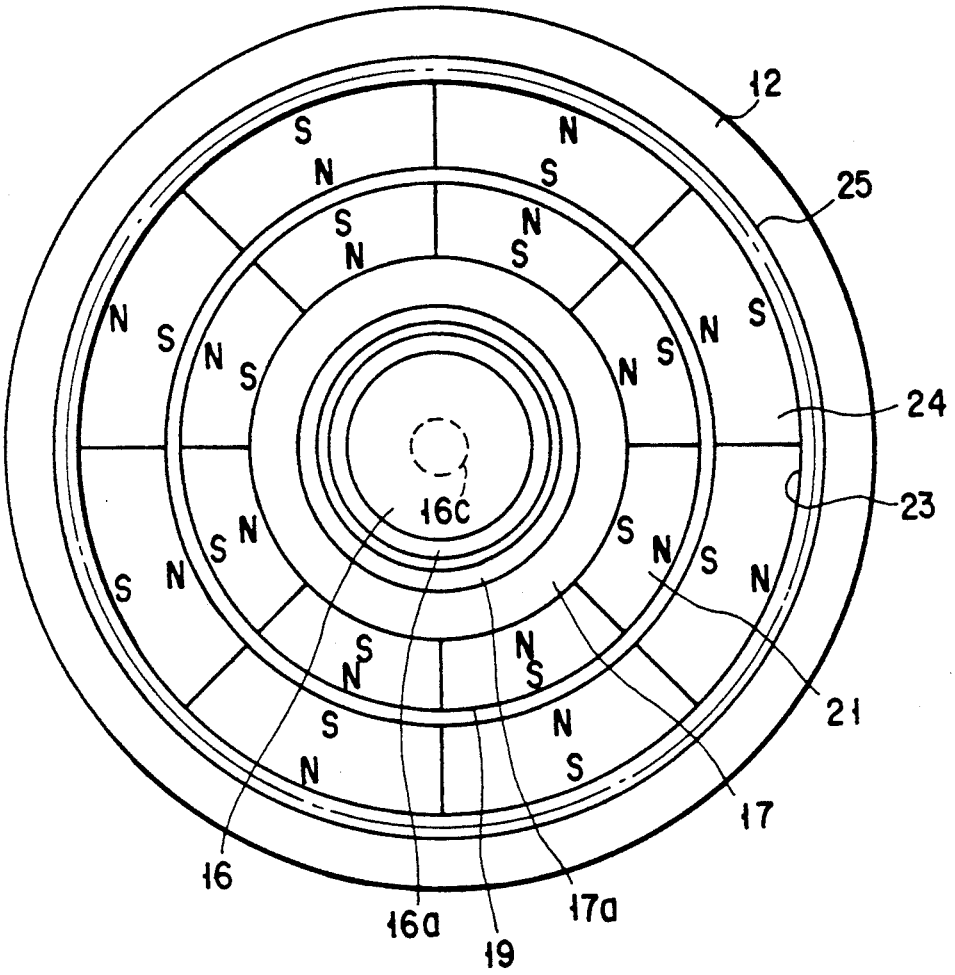
FIG. 3 is a plan view showing a magnetizing state of driven and driving rings.

The outer disk 17 is disposed to surround the inner disk 16 at a predetermined gap to be coaxial with it, i.e., such that the center of rotation of the outer disk 17 coincides with that of the inner disk 16. The outer disk 17 is held in a floating state by a magnetic force. That is, the outer disk 17 is mounted at the inner side, along the radial direction, of the upper surface of a holding ring 19 which is surrounding the inner disk 16. A driven ring 21, which is alternately magnetized to the N and P poles along its circumferential direction as shown in FIG. 3, is provided on the outer side, along the radial direction, of the upper surface of the holding ring 19. A repulsive ring 22, the upper surface of which is magnetized to the N pole, is disposed below the lower surface of the holding ring 19 to oppose it at a predetermined gap. The holding ring 19 is magnetized such that its lower surface in the direction of thickness becomes the N pole.

The opposing surfaces of the repulsive and holding rings 22 and 19 are magnetized to the same pole. Thus, a magnetic repulsive force is generated between the rings 22 and 19 to hold the holding ring 19 in the floating state together with the outer disk 17. The magnetic repulsive force generated between the holding and repulsive rings 19 and 22 is set to a magnitude to float the outer disk 17 at substantially the same level with the inner disk 16.

The repulsive ring 22 is held by a holding mechanism 36 and adjusts the gap with respect to the holding ring 19 as required, thereby controlling the magnetic repulsive force generated between the repulsive and holding rings 22 and 19. In other words, the repulsive ring 22 adjusts the floating height of the holding ring 19.

A stepped portion 23 is formed in the upper portion of the inner circumferential surface of the rotary member 12. A driving ring 24 is provided in the stepped portion 23. The driving ring 24 is alternately magnetized to the N and S poles along its circumferential direction so as to oppose the opposite poles formed on the driven ring 21, as shown in FIG. 3. Thus, the driving and driven rings 24 and 21 are coupled to each other by a magnetic attractive force. In other words, the driving and driven rings 24 and 21 constitute a magnet coupling.

An internal gear 25 is formed in the upper portion of the inner circumferential surface of the stepped portion 23. The internal gear 25 is meshed with a driving gear 27 which is driven by a second power source 26. The second power source 26 is mounted on a top plate 37 arranged above the rotary member 12.

Hence, when the second power source 26 is operated to rotate the driving gear 27 to rotate the rotary member 12 through the internal gear 25, the driven ring 21 which is coupled to the driving ring 24 by the magnetic attractive force can be rotated integrally with the rotary member 12. Accordingly, the outer disk 17 integrally provided with the driven ring 21 is also rotated.

The upper ends of the outer circumferences of the inner and outer disks 16 and 17 form surfaces **16*a*** and 17*a*, respectively, which are inclined at a predetermined angle, i.e., 45°. The pair of inclined surfaces 16*a* and 17*a* form a holding portion 28 having a substantially V-shaped section. A plurality of ceramic balls 29 which are to be polished are rollably held in the holding portion 28.

Figure 4:
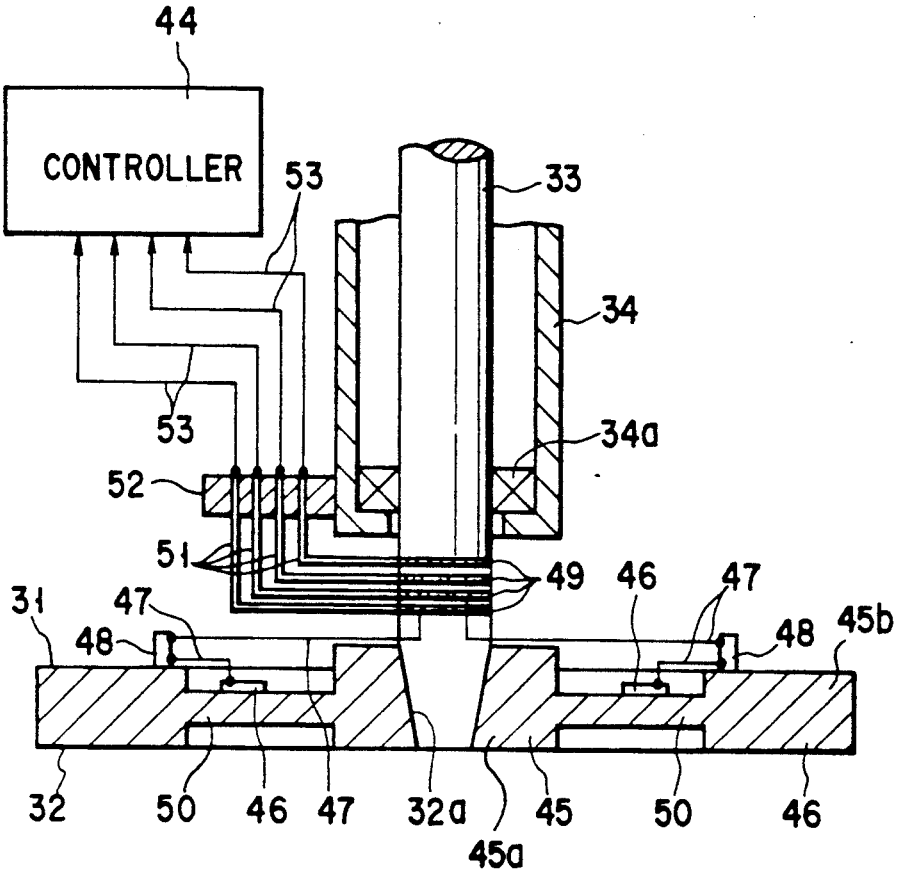
FIG. 4 is a sectional view showing a connecting state between strain gauges provided on an upper polishing disk, and a controller.

An upper polishing disk 31 is arranged above the lower polishing disk 18. The upper polishing disk 31 comprises a disk portion 32 and a shaft portion 33, as shown in FIG. 4. The diameter of the disk portion 32 is larger than that of the inner disk 16 of the lower polishing disk 18, and a lower end portion of the shaft portion 33 is fitted in a fitting hole 32*a* formed at the central portion of the disk portion 32. The shaft portion 33 is inserted in a sleeve 34 and rotatably supported by a bearing 34*a*. A male thread 35 is formed in the upper portion of the outer circumferential surface of the sleeve 34, as shown in FIG. 2. The male thread 35 is threadably engaged with a female thread portion 38 formed in the top plate 37. A third power source 39 is integrally provided on the upper end of the sleeve 34, and the shaft portion 33 is rotated by the power source 39.

A driven gear 41 is provided on the upper end portion of the sleeve 34. The driven gear 41 is meshed with a driving gear 42. The driving gear 42 is rotated by a fourth power source 43 provided on the top plate 37. When the sleeve 35 is rotated by the fourth power source 43 through the driving and driven gears 42 and 41, the sleeve 35 is moved in the vertical direction by the threadable engagement of its male thread 35 with the female thread portion 38. This changes the gap between the lower and upper polishing disks 18 and 31. In other words, a machining load (polishing load) of the upper polishing disk 31 against the balls 29 held by the holding portion 38 can be controlled.

Figure 5:
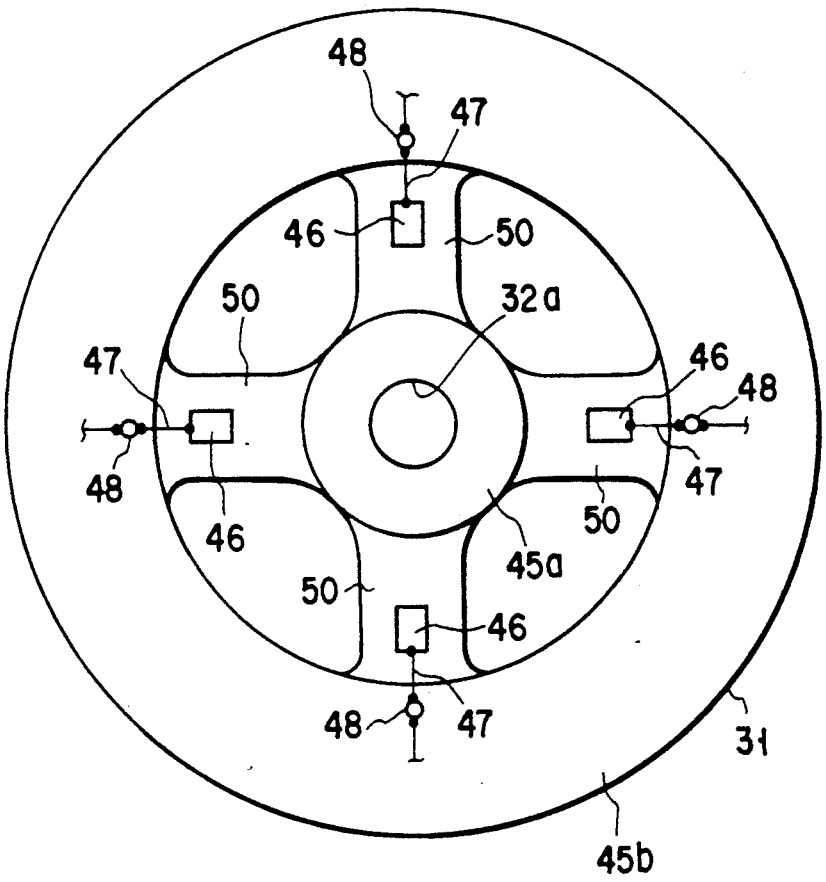
FIG. 5 is a plan view showing the arrangement of the strain gauges provided on the upper polishing disk.

The fourth power source 43 is controlled by a controller 44. The polishing load applied to the upper polishing disk 31 is input to the controller 44. That is, in the disk portion 32 of the upper polishing disk 31, its central and peripheral portions 45*a* and 45*b* are coupled to each other by four arms 50 arranged at equal angular intervals of 90° in the circumferential direction, as shown in FIG. 5. A strain gauge 46 is mounted at an intermediate portion of the upper surface of each arm 50. One end of a first lead wire 47 is connected to each strain gauge 46.

The four lead wires 47 are respectively electrically connected to four conductive zones 49, provided at the lower end portion of the shaft portion 33, through pins 48 provided on the peripheral portion 45*b* of the upper disk 31, as shown in FIG. 4. One end of each brush 51 contacts each conductive zone 49. The other end portion of each brush 51 is supported by a bracket 52 provided to extend from the lower end portion of the sleeve 34. One end of each second lead wire 53 is connected to the other end of the corresponding brush 51. The second lead wires 53 are guided to the controller 44 and connected such that the four strain gauges 46 form a bridge circuit (not shown) in the controller 44. An output signal from the bridge circuit is compared with a preset value set in the controller 44.

When a difference occurs between the output signal and the preset value, the controller 44 outputs a drive signal to the fourth power source 43. Then, the sleeve 34 is driven by the power source 43 to move upward or downward, and the upper polishing disk 31 is interlocked with the movement of the sleeve 34 to control the gap with respect to the lower polishing disk 18, i.e., the polishing load.

This control will be described in more detail. When the balls 29 are to be polished by the upper polishing disk 31, an output from the bridge circuit constituted by the strain gauges 46 varies depending on the contact force (polishing load) between the upper polishing disk 31 and the balls 29. For example, when unmanned coarse polishing of the balls 29 is continued over a long period of time, the polishing load is decreased as the machining proceeds. In this case, an output from the bridge circuit becomes close to zero and a difference between the output and the preset value becomes large. Then, the upper polishing disk 31 is driven to move downward Thus, the machining load of the upper polishing disk 31 on the balls 29 is maintained at a predetermined value.

Inversely, when galling occurs between the upper disk 31 and the balls 29 and an output from the bridge circuit becomes larger than the preset value, the upper disk 31 is driven to move upward to maintain the polishing load at the predetermined value. Thus, the upper polishing disk 31 can be prevented from being damaged.

A polishing agent is supplied from a nozzle (not shown) to the holding portion 28.

The operation of polishing the balls 29 by the polishing apparatus having the above arrangement will be described.

The outer disk 17 of the lower polishing disk 18 is held at a height by the magnetic repulsive force generated between the holding and repulsive rings 19 and 22 to keep a predetermined positional relationship with the inner disk 16. The height of the outer disk 17 can be adjusted by the holding mechanism 36. The holding portion 28 is caused to hold the multiple of balls 29. Then, the first to third power sources 14, 26, and 39 are operated to rotate the inner disk 16 of the lower polishing disk 18 and the upper polishing disk 31 in the opposite directions and to rotate the rotary member 12 in the same direction as the inner disk 16 of the lower polishing disk 18. When the rotary member 12 is rotated, the outer disk 17 is rotated in the same direction as the inner disk 16 by the magnetic coupling of the driving ring 24 and the driven ring 21. In other words, the inner disk 16 and the outer disk 17 of the lower disk 18 are rotated together.

The fourth power source 43 is operated to move the upper polishing disk 31 downward so that the lower surface of the disk portion 32 of the upper polishing disk 31 is brought into contact with the balls 29, held by the holding portion 28 defined by the inner and outer disks 16 and 17, with a predetermined polishing load. Then, the balls 29 are polished as they are rotated about their axes and the axis of each disk by the three-point contact among the inclined surfaces 16*a* and 17*b* of the holding portion 28 and the disk portion 32 of the upper polishing disk 31. At this time, the outer disk 17 is moved downward against the magnetic repulsive force.

The shape precision, i.e., sphericity and size, of the multiple of balls 29 supplied to and held by the holding portion 28 varies, and the polishing load applied on each respective ball 29 is changed in accordance with this variation. When the polishing load is changed, the outer disk 17 of the lower polishing disk 18 is moved in accordance with this change against the magnetic repulsive force with respect to the repulsive ring 22.

For example, assume that the balls 29 have a size variation and a size difference. For a ball 29 having a large diameter, the outer disk 17 is moved downward against the magnetic repulsive force with respect to the repulsive ring 22, and for a ball 29 having a small diameter, the outer disk 17 is moved upward by the repulsive force received from the repulsive ring 22. In this manner, if the outer disk 17 is moved by the magnetic force in accordance with the size variation and diameter difference of the balls 29, the balls 29 in the holding portion 28 can be prevented from being applied with an excessive polishing force. Then, galling does not occur between the balls 29 and the upper and lower polishing disks 31 and 18.

The outer disk 17 is biased by the magnetic repulsive force between the holding and repulsive rings 19 and 22 to keep a predetermined positional relationship with the inner disk 16 and upper polishing disk 31. Therefore, if polishing of the balls 29 is continued until the outer disk 17 has a predetermined positional relationship with the inner disk 16 and upper polishing disk 31, i.e., until the outer disk 17 is not pushed by the balls 29 and its height is determined by only the magnetic repulsive force, the balls 29 held by the holding portion 28 can be precisely polished to have a uniform shape free from a size difference.

The polishing load of the upper polishing disk 31 on the balls 29 is detected by each strain gauges 44, input to the controller 44, and compared with the preset value by the controller 44. When a difference occurs between the detection signal from each strain gauge 46 and the preset value of the controller 44, the upper polishing disk 31 is vertically driven to control the polishing load on the balls 29 by an in-process such that this difference is eliminated. For this reason, if, e.g., unmanned coarse polishing is performed over a long period of time, the polishing load is constantly maintained at an appropriate value even when machining proceeds, and thus unmanned precision machining is enabled.

In this embodiment, regarding especially a change in diameter of each bal 29 accompanying the progress of polishing and a macroscopic change in load to the ball 29 caused by the vertical movement of the outer disk 17 because of wear of the upper polishing disk 31, inner, and outer disks 16, 17, the upper polishing disk 31 is vertically moved by the fourth power source 43 on the basis of the detection signals from the strain gauges 46 to adjust these changes by the in-process such that a predetermined polishing load can be obtained. Simultaneously, regarding a size variation (variation in diameter among individual balls of one lot) of the balls 29 and a microscopic change in load which occurs instantaneously due to the difference in diameter of the individual balls 29, they can be automatically polished by the magnetic repulsive force between the holding and repulsive rings 19 and 22 by the in-process. In this manner, because of the two relative cooperative operations including the macroscopic and microscopic adjusting operations of the load, the ball machining precision is greatly improved as compared to a case in which only either the macroscopic or microscopic adjusting operation of the load is performed.

Figure 6:
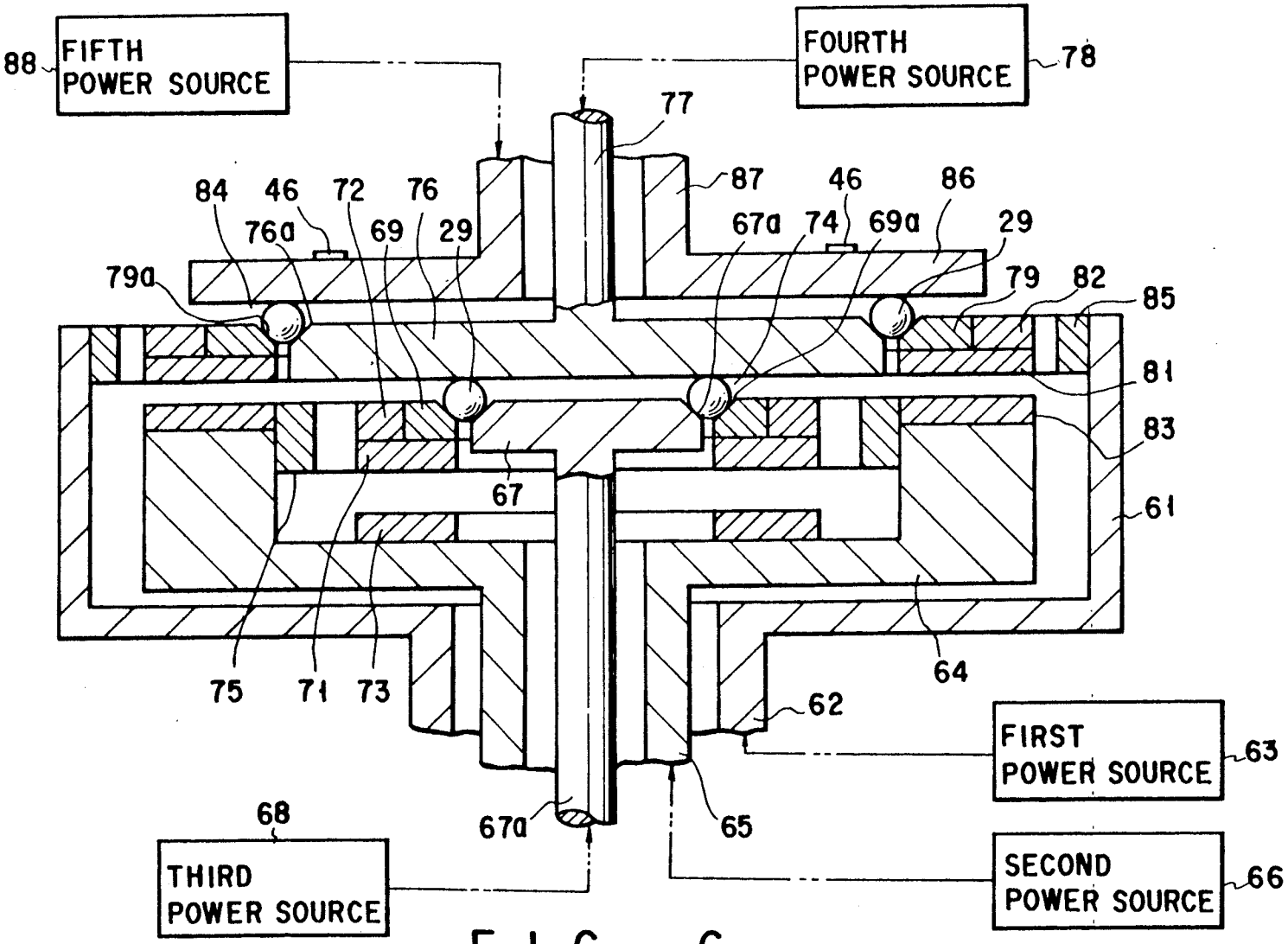
FIG. 6 is a sectional view showing the overall arrangement of a polishing apparatus according to the second embodiment of the present invention.

FIG. 6 shows the second embodiment of the present invention. Referring to FIG. 6, reference numeral 61 denotes a first bottomed member having an open upper surface. The upper end of a first hollow shaft 62 is coupled to the central portion of the bottom portion of the first cylindrical member 61. Thus, the lower end of the first hollow shaft 62 is coupled to a first power source 63. The first cylindrical member 61 is then rotated.

A second cylindrical member 64 having a similar shape to the cylindrical member 61 is disposed in the first cylindrical member 61. The upper end of a second hollow shaft 65 having a diameter smaller than that of the first hollow shaft 62 is coupled to the central portion of the bottom portion of the second cylindrical member 64. The second hollow shaft 65 extends through the first hollow shaft 62, and its lower end portion is coupled to a second power source 66. The second hollow shaft 65 is rotated in a direction opposite to that of the first hollow shaft 62.

A first inner disk 67 is provided in the second cylindrical member 64. A first driving shaft **67*a* is provided to extend from the lower surface of the first inner disk 67. The first driving shaft 67*a* extends through the second hollow shaft 65, and its lower end is coupled to a third power source 68. The first driving shaft 67*a* is driven to rotate in the same direction as the second hollow shaft 65**.

A first annular outer disk 69 is surrounding the first inner disk 67. The first outer disk 69 is mounted at the radially inner portion of the upper surface of a first annular holding ring 71, and the lower side of the disk 69 in the direction of thickness is magnetized to the N pole. A first driven ring 72 which is alternately magnetized to the S and N poles along its circumferential direction is provided on the radially outer portion of the upper surface of the holding ring 71.

A first repulsive ring 73 having the upper side, which opposes the first holding ring 71 and is magnetized to the N pole, is provided on the inner bottom portion of the second cylindrical member 64. The first outer disk 69 is held in the floating state by the magnetic repulsive force between the repulsive and holding rings 73 and 71.

The upper ends of the outer and inner circumferences of the first inner and outer disks 67 and 69 form surfaces **67*a* and 69*a*, respectively, which are inclined at predetermined angles, i.e., 45°. The inclined surfaces 67*a* and 69*a* form a first annular holding portion 74 for rollably holding ceramic balls 29** as the works.

A first driving ring 75, which is magnetized to generate a magnetic attractive force with respect to the first driven ring 72, is provided at a location of the upper portion of the inner circumferential surface of the second cylindrical member 64 to oppose the first holding and driven rings 71 and 72. In other words, the driving ring 75 and the first holding and driven rings 71 and 72 are coupled to each other by the magnetic attractive force. Thus, when the second cylindrical member 64 is rotated together with the first inner disk 67, the first outer disk 69 magnetically coupled to the first driving ring 75 is rotated in the same direction.

A second inner disk 76 having a diameter larger than that defined by the first holding portion 74 is disposed above the first inner disk 67 such that its lower surface opposes the upper surface of the first inner disk 67 in a parallel manner. A second driving shaft 77 is provided on the upper surface of the second inner disk 76. The second driving shaft 77 is rotated by a fourth power source 78 in the direction opposite to the first inner disk 67.

A second annular outer disk 79 is surrounding the second inner disk 76. The second outer disk 79 is provided on the radially inner portion of the upper surface of a second annular holding ring 81, and the upper surface of the disk 79 in the direction of thickness is magnetized to the N pole. A second driven ring 82 which is alternately magnetized to the S and N poles along its circumferential direction is provided on the radially outer portion of the upper surface of the second holding ring 81.

The outer diameter of the second holding ring 81 is formed to be substantially the same as that of the second cylindrical member 64. The second holding ring 81 is held in the floating state by the magnetic repulsive force generated between the holding ring 81 and a second repulsive ring 83 provided on the upper end face of the second cylindrical member 64.

The upper ends of the outer and inner circumferential portions of the second inner and outer disks 76 and 79 respectively form surfaces 76*a* and 79*a* which are inclined at predetermined angles, i.e. 45°. The inclined surfaces 76*a* and 79*a* define a second annular holding portion 84 for rollably holding the balls 29.

A second driving ring 85 is provided at a location of the upper portion of the inner circumferential surface of the first cylindrical member 61 to oppose the second holding and driven rings 81 and 82. The second driving ring 85 is magnetized to generate a magnetic attractive force with respect to the second holding and driven rings 81 and 82. Thus, when the first cylindrical member 61 is rotated, the second holding ring 81 is interlocked with this rotation by the magnetic attractive force.

A third inner disk 86 is disposed above the second inner disk 76 such that its lower surface is spaced apart to be parallel with the upper surface of the second inner disk 76. The third inner disk 86 is a circular disk having a diameter larger than that defined by the second holding portion 84, and a third hollow shaft 87 is provided on the upper surface of the third inner disk 86. The second driving shaft 77 extends through the third hollow shaft 87.

The third hollow shaft 87 is coupled to a fifth power source 88. The fifth power source 88 drives the third inner disk 86 to rotate in the direction opposite to the second inner disk 76.

The second and third inner disks 76 and 86 can be vertically positioned by vertical driving mechanisms (not shown).

According to the polishing apparatus having the arrangement described above, the balls held by the first holding portion 74 are polished by the polishing load supplied from the second inner disk 76, and the balls 29 held by the second holding portion 84 are polished by the polishing load supplied from the third inner disk 86.

When the balls 29 held by the holding portions 74 and 84 have a size difference or a diameter difference, the first and second outer disks 69 and 79 which define the respective holding portions are moved in accordance with the size difference or diameter difference against the magnetic repulsive forces with respect to the first and second repulsive rings 73 and 83. Thus, the balls 29 in the holding portions 74 and 84 can be prevented from being applied with an excessive polishing force, and no galling occurs among the inner disks 67, 76, and 86.

If polishing is continued until the first and second outer disks 69 and 79 are set in predetermined floating states by the magnetic repulsive forces with respect to the repulsive rings 73 and 83, respectively, the balls 29 held by the holding portions 74 and 84 can be uniformly polished with high precision without causing a size variation.

Since the first and second holding portions 74 and 84 are vertically formed, if balls 29 having different sizes and materials are supplied to them, two types of balls 29 can be polished by a single machining and, if the same type of balls are to be polished, the number of machined balls can be increased twice or more, thus improving the productivity.

In the second embodiment, the two holding portions are vertically provided. However, three or more holding portions can be formed by stacking more inner and outer disks.

In the second embodiment, four strain gauges 46 (only two are shown) are also provided to the uppermost third inner disk 86 in the same manner as in the first embodiment. The strain gauges 46 detect the polishing load applied on the third inner disk 86, and output signals from the strain gauges 46 are input to a controller 44 of the same type as that shown in the first embodiment. The controller 44 compares each detection signal with a preset value set in the controller 44 and vertically controls the third inner disk 86 such that the comparison value becomes constant. Hence, the polishing loads of the second and third inner disks 76 and 86 on the balls 29 can always be maintained at constant values.

When the uppermost third inner disk 86 is vertically driven, the second and first inner disks 76 and 67 below it are interlocked with this vertical movement, and thus the polishing loads on the balls 29 held by the first and second holding portions 74 and 84 can be maintained at constant values.

Figure 7:
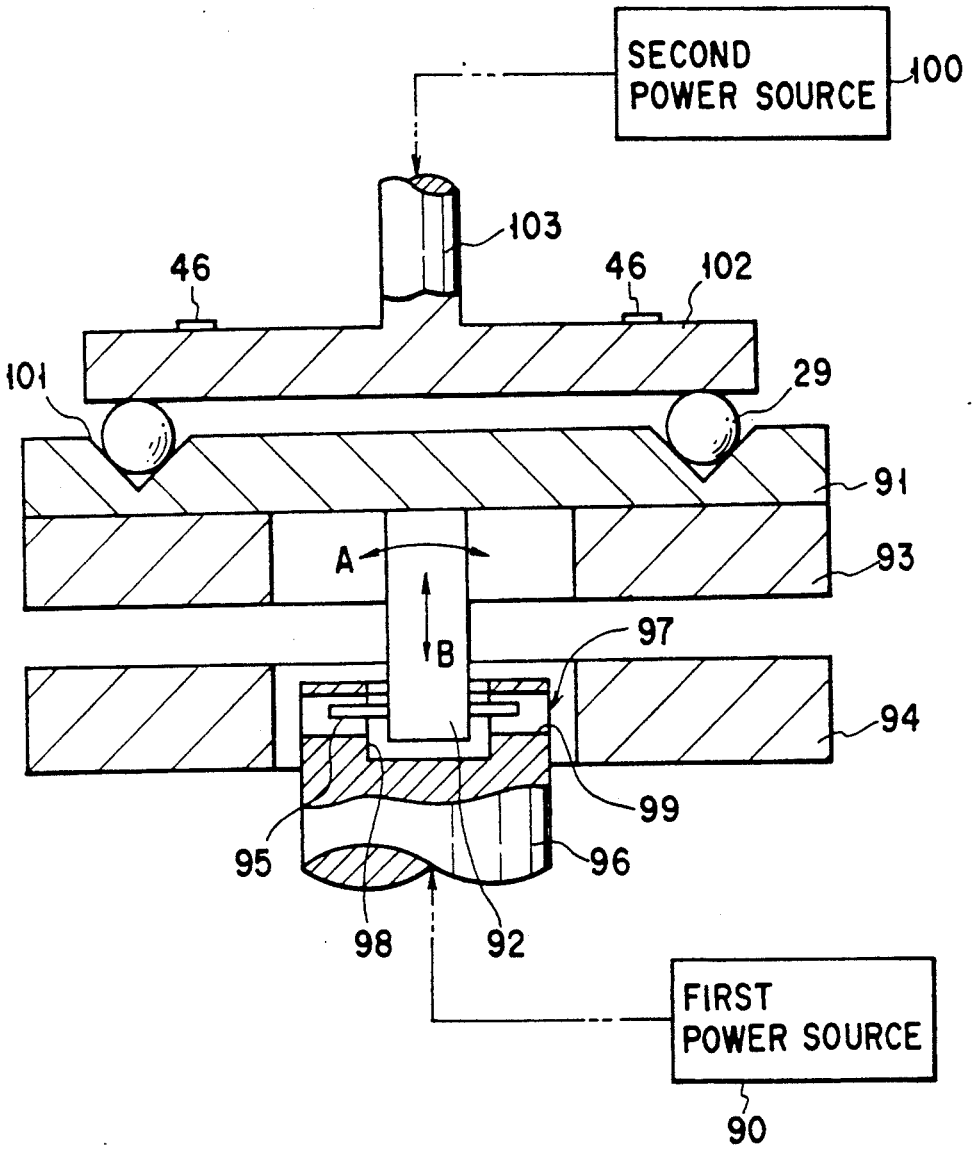
FIG. 7 is a sectional view showing the overall arrangement of a polishing apparatus according to the third embodiment of the present invention.

FIG. 7 shows the third embodiment of the present invention. Referring to FIG. 7, reference numeral 91 denotes a lower polishing disk. A support shaft 92 is provided to extend from the central portion of the lower surface of the lower polishing disk 91. A first ring 93, which is magnetized such that its lower side in the direction of thickness becomes the N pole, is bonded and fixed to the peripheral portion of the lower surface of the lower polishing disk 91. A second ring 94 having the upper surface, which opposes the first ring 93 and is magnetized to the N pole, is stationarily disposed below the first ring 93. A magnetic repulsive force is generated between the second and first rings 94 and 93, and the lower polishing disk 91 is held in the floating state by this magnetic repulsive force.

A pin 95 is provided on the lower end of the support shaft 92 to extend through it in the radial direction. The support shaft 92 is coupled to a coupling portion 97, formed in the upper end portion of a driving shaft 96, through the pin 95. The driving shaft 96 is driven by a first power source 90. The coupling portion 97 comprises an insertion hole 98, formed to open to the upper end face of the driving shaft 96 and having a diameter sufficiently larger than that of the support shaft 92, and an engaging groove 99 intersecting with the insertion hole 98 and formed to extend through the driving shaft 96 in the radial direction. The support shaft 92 is inserted in the insertion hole 98 by engaging the groove 99 with the pin 95 provided to extend through the lower end portion of the support shaft 92 in the radial direction.

Hence, the support shaft 92 is interlocked with the rotation of the driving shaft 96 through the pin 95 and is movable in the swinging direction indicated by an arrow A and the vertical direction indicated by an arrow B.

An annular holding portion 101 comprising a groove having a V-shaped section is formed in the upper surface of the lower polishing disk 91, and a multiple of ceramic balls 29 as the works are rollably held in the holding portion 101.

An upper polishing disk 102 is provided above the lower polishing disk 91 such that its lower surface is spaced apart to be parallel with the upper surface of the lower polishing disk 91. A driving shaft 103 is provided to extend from the upper surface of the upper polishing disk 102. The driving shaft 103 is driven by a second power source 100. The second power source 100 is vertically driven by a vertical driving mechanism (not shown) together with the upper polishing disk 102. In other words, the upper polishing disk 102 can be rotated and vertically moved.

According to the polishing apparatus having the arrangement described above, to polish the balls 29, the multiple of balls 29 are supplied to the holding portion 101, and the upper polishing disk 102 is moved downward to bring its lower surface into contact with the balls 29 with a predetermined pressure. In other words, a predetermined polishing load is applied to the balls 29. Then, the lower polishing disk 91 and the upper polishing disk 102 are rotated in the opposite directions to cause the balls 29 held by the holding portion 101 to rotate about the axis of the disk 102 while rotating about the axes of the balls 29. Thus, the balls 29 are polished by the disks 91 and 102. At this time, a polishing liquid is supplied from a nozzle (not shown) to the holding portion 101.

When the balls 29 held by the holding portion 101 have a size variation or a diameter difference, the lower polishing disk 91 is moved in accordance with this size variation or diameter difference against the magnetic repulsive force between the first and second rings 93 and 94. Also, the lower polishing disk 91 swings in the direction indicated by arrow A, in accordance with the size variation or diameter difference between the balls 29. In other words, the support shaft 92 swings away from the axis of the driving shaft 96. Hence, the holding portion 101 can be prevented from being applied with an excessive polishing force, and no galling occurs between the balls 29 and the disks 91 and 102.

When polishing is continued until the lower disk 91 is set in a predetermined floating state by the magnetic repulsive force between the first and second rings 93 and 94, the balls 29 held by the holding portion 101 can be precisely polished to have a uniform shape free from a size difference.

In the third embodiment, four strain gauges 46 (only two are shown) are also mounted on the upper surface of the upper disk 102 at angular intervals of 90x in the circumferential direction in the same manner as in the first embodiment. The detection signals from the strain gauges 46 are input to a controller 44 of the same type as that shown in the first embodiment. The controller 44 compares each detection signal with the preset value. The controller 44 outputs a drive signal in accordance with a comparison result to vertically drive the upper polishing disk 102. Thus, the gap between the upper and lower disks 102 and 91, i.e., the polishing loads applied to the balls 29 can always be maintained at a constant value.

In the embodiments described above, each ring is constituted by a permanent magnet. However, each ring can be constituted by an electromagnet. Then, the magnetic force can be easily controlled, thus changing the polishing loads applied on the balls.

Figure 8:
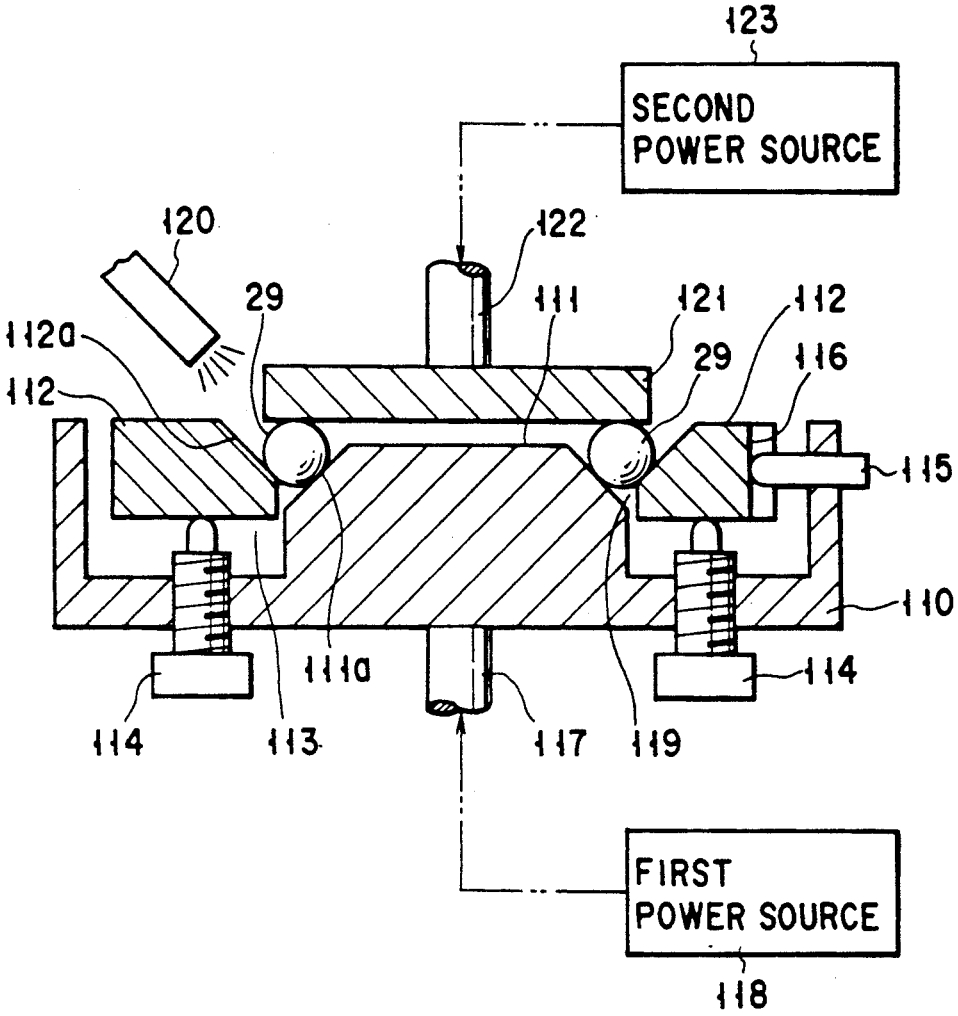
FIG. 8 is a sectional view showing the overall arrangement of a polishing apparatus according to the fourth embodiment of the present invention.
Figure 9:
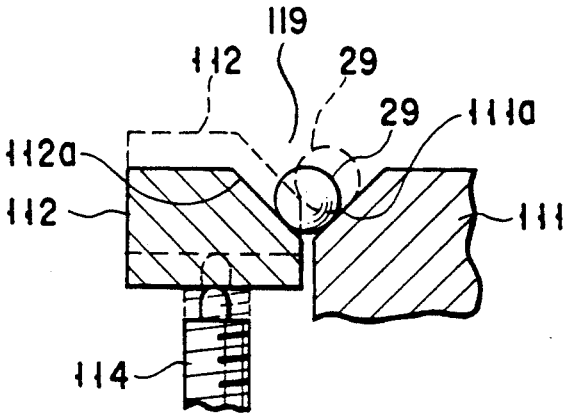
FIG. 9 is a view for explaining a state in which an outer disk is moved upward.

FIGS. 8 and 9 show the fourth embodiment of the present invention. Referring to FIG. 8, reference numeral 110 denotes a bottomed cylindrical holding member having an open upper surface. A circular inner disk 111 is provided on the inner bottom portion of the holding member 110. An annular outer disk 112 is surrounding the inner disk 111. The inner and outer disks 111 and 112 constitute a lower polishing disk 113.

A plurality of screw shafts 114 are threadably engaged in the bottom portion of the holding member 110. The distal end of each of the screw shafts 114 projects into the holding portion 110 to contact the lower surface of the outer disk 112. In other words, the outer disk 112 is held at a predetermined height in the holding member 110 by the screw shafts 114, and the height of the outer disk 112 can be adjusted by rotating the screw shafts 114.

An engaging shaft 115 is provided to extend through the circumferential wall of the holding member 110 and project from the inner surface of the holding member 110. The distal end portion of the engaging shaft 115 is engaged with an engaging groove 116 formed in the outer circumferential surface of the outer disk 112 in the direction of thickness. Hence, the outer disk 112 is prevented from rotating in the circumferential direction against the holding member 110. A rotating shaft 117 is provided on the lower surface of the holding member 110. The rotating shaft 117 is driven by a first power source 118.

The upper end of the outer circumference of the inner disk 111 forms a surface **111*a* inclined at an angle of 45°, and the upper end of the inner circumference of the outer disk 112 forms a surface 112*a* inclined at an angle of 45°. The inclined surfaces 111*a* and 112*a* define a holding portion 119 having a substantially V-shaped section. A multiple of ceramic balls 29, which are to be polished in a manner to be described later, are rollably held in the holding portion 119. When the balls 29 are to be polished, an polishing liquid containing polishing grains is supplied from a nozzle member 120 to the holding portion 119**.

An upper polishing disk 121 is arranged above the lower polishing disk 113. A rotating shaft 122 is provided on the upper surface of the upper polishing disk 121. The rotating shaft 122 is driven by a second power source 123. The second power source 123 and the upper polishing disk 121 are integrally formed and are driven by a vertical driving mechanism (not shown) in the vertical direction, i.e., in a direction to approach and separate from the lower polishing disk 113.

An operation of polishing the balls 29 will be described.

When the upper polishing disk 121 is moved upward to a predetermined position and the balls 29 are supplied to the holding portion 119, the upper polishing disk 121 is moved downward to bring its lower surface into contact with the balls 29 with a predetermined pressure. Subsequently, the first and second power sources 118 and 123 are operated to rotate the holding member 110 and the upper polishing disk 121 in the opposite directions. When the holding member 110 is rotated, the lower polishing disk 113 is rotated. Thus, the balls 29 held by the holding portion 119 of the lower polishing disk 113 are polished by rotation of the disks 113 and 121.

During this polishing, when the screw shafts 114 are slightly screwed to move the outer disk 112 slightly upward, as indicated by a broken line in FIG. 9, the balls 29 held in the holding portion 119 contact other portions, i.e., non-wear portions of the pair of inclined surfaces 111*a* and 112*b* defining the holding portion 119. At this time, the upper polishing disk 121 is moved upward in synchronism with the upward movement of the screw shafts 114. For this purpose, a pulse motor (not shown) may be integrally provided with the screw shafts 114 to drive the screw shafts 114.

When polishing of the balls 29 are performed in this manner by moving the outer disk 112 upward, wide ranges of the inclined surfaces 111*a* and 112*a* can be used as the machining surfaces. Thus, wear of only part of the machining surface can be prevented not to degrade machining precision and to reduce the frequency of replacement of the lower polishing disks 113.

In this embodiment, the inner disk 111 may be moved in place of the outer disk 112. For example, if the screw shafts 114 are provided to be rotatable and not to move in the axial direction, the inner disk 112 can be moved together with the holding member 110 by rotating the screw shafts 114.

Figure 10:
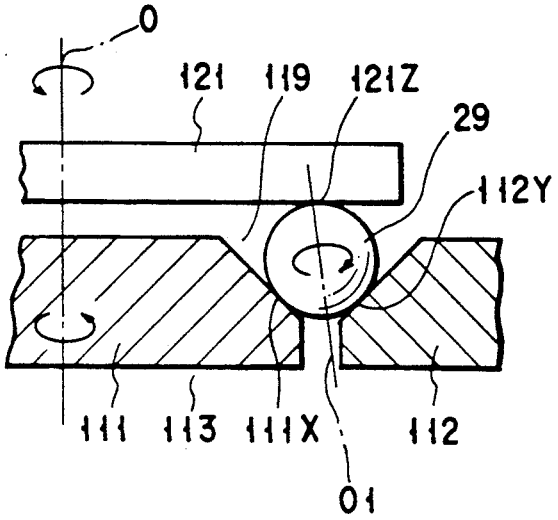
FIG. 10 is a view for explaining rotation about an axis of a ball and rotation about an axis of each disk.

A case in which balls 29 each having a small diameter of, e.g., about ⅜", are polished by using the apparatus having the arrangement described above will be described with reference to FIGS. 10 and 11. In this case, the balls 29 need be imparted with appropriate rotation about their axes and rotation about the axis of each disk. FIG. 10 is an enlarged view of a portion constituting a holding portion 119 having a similar arrangement to that of the abrading apparatus shown in FIG. 8. In the holding portion 119, inner and outer disks 111 and 112 of a lower polishing disk 113 and an upper polishing disk 121 are driven by different power sources (not shown). Thus, the rotational speeds of the inner and outer disks 111 and 112 of the lower polishing disk 113 and the upper polishing disk 121 can be controlled independently of each other.

Figure 11:
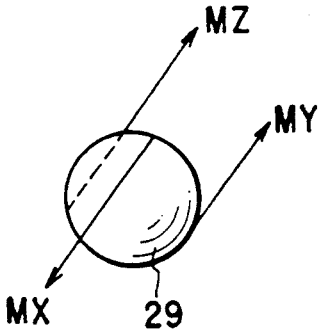
FIG. 11 is a view for explaining moments generated in a ball.

That is, when the inner and outer disks 111 and 112 and the upper polishing disk 121 are controlled by the separate power sources, a difference between moments generated at contact points 111X and 112Y between the ball 29 and the holding portion 119 and contributing to rotation of each ball 29 which is caused by a difference in radius of rotation with respect to an axis O of rotation can be arbitrarily set. When the moment generated at a contact point 121Z between the ball 29 and the upper disk 121 is balanced with the moments contributing to rotation of the ball 29, the ball 29 can be imparted with optimum rotation about its axis and rotation about the axis of each disk. FIG. 11 shows moments Mx, My, and Mz generated at the contact points 111X, 112Y, and 121Z where the ball 29 contacts the three disks 111, 112, and 121.

According to the arrangement described above, an axis of rotation denoted as $O_1$ in FIG. 10 can be provided to each ball 29 by balancing the rotational speeds of the three disks 111, 112, and 121. Therefore, if the ball 29 is imparted with an arbitrary angle of rotation to set equal slip quantities and slip speeds at the contact points 111X, 112Y, and 121Z with the three disks 111, 112, and 121, the ball 29 can be polished with high sphericity at a high speed.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A ball polishing apparatus for polishing a ball, comprising:

a lower polishing disk having an inner disk and an annular outer disk surrounding said inner disk and coaxial therewith, an outer circumferential portion of said inner disk and an inner circumferential portion of said outer polishing disk forming a holding portion for rollably holding the ball;

magnetic holding means for holding said outer disk in a state in which said outer disk is movable with reference to said inner disk in an axial direction of said inner disk, said magnetic holding means including a holding ring provided for a lower surface of said outer disk and a repulsive ring located in opposition to the holding ring, said holding ring and said repulsive ring being magnetized and arranged with their same-polarity portions facing each other, to thereby generate a magnetic repulsive force by which to hold said outer disk in a floating state;

first driving means for driving said inner disk;

second driving means for driving said outer disk without impairing the floating state of said outer disk achieved by the magnetic force;

an upper polishing disk opposing said lower polishing disk, for pushing the ball held by said holding portion; and third driving means for driving said upper polishing disk.

2. An apparatus according to claim 1, wherein said magnetic holding means comprises a holding ring, constituted by a permanent magnet provided on a side of a lower surface of said outer disk, and a repulsive ring, provided at a location to oppose said holding ring, for generating a magnetic repulsive force with respect to said holding ring.

3. An apparatus according to claim 1, wherein said upper polishing disk and said third driving means are integrally provided and are driven by fourth driving means in a direction to approach and separate from said lower polishing disk.

4. An apparatus according to claim 3, comprising:

detecting means for detecting a load applied on the ball by said upper polishing disk; and control means for driving said fourth driving means by a detection signal supplied from said detecting means in order to control the load applied on the ball by said upper polishing disk.

5. An apparatus according to claim 4, wherein said detecting means is a strain gauge provided on said upper polishing disk.

6. A ball polishing apparatus for polishing a ball, comprising:

a base;

a rotary member constituting a cylindrical member and provided on said base to be rotatable about an axis of the cylindrical member;

a lower polishing disk having an inner disk and an annular outer disk surrounding said inner disk and coaxial therewith, and provided in said rotary member, an outer circumferential portion of said inner disk and an inner circumferential portion of said outer disk, forming a holding portion for rollably holding the ball;

magnetic holding means for holding said outer disk in a state where said outer disk is movable with reference to said inner disk in an axial direction of said inner disk, said magnetic holding means including a holding ring provided for a lower surface of said outer disk and a repulsive ring located in opposition to the holding ring, said holding ring and said repulsive ring being magnetized and arranged with their same-polarity portions facing each other, to thereby generate a magnetic repulsive force by which to hold said outer disk;

first driving means for driving said inner disk;

magnetic coupling means, provided at an inner circumferential portion of said cylindrical member, for coupling said outer disk with said cylindrical member in a non-contact manner by a magnetic force;

second driving means for integrally rotating said outer disk and said cylindrical member through said magnetic coupling means provided to said cylindrical member by driving said cylindrical member;

an upper polishing disk opposing said lower polishing disk, for pushing the ball held by said holding portion;

third driving means, being integral with said upper polishing disk, for driving said upper polishing disk;

fourth driving mean, for driving said upper polishing disk in a direction to approach and separate from said lower polishing disk;

detecting means for detecting a load which said upper polishing disk applies to the ball; and control means for controlling the load which said upper polishing disk applies to the ball, by driving said fourth driving means in accordance with a detection signal supplied from said detecting means.

7. An apparatus according to claim 6, wherein said second driving means comprises an integral gear formed on the inner circumferential surface of said cylindrical member, a driving gear meshed with said internal gear, and a power source for driving said driving gear.

8. A polishing method of polishing a ball with upper and lower polishing disks, comprising the steps of:

holding an outer disk by a magnetic repulsive force and in a state in which said outer disk is movable with reference to said inner disk in an axial direction of said inner disk, by using said lower polishing disk constituted by said inner disk and said outer disk surrounding said inner disk and coaxial therewith;

supplying a ball to a holding portion formed by an outer circumferential portion of said inner disk and an inner circumferential portion of said outer disk;

pushing the ball held by said holding portion by said upper polishing disk with a predetermined load; and driving said inner disk, outer disk, and upper polishing disk.

9. A method according to claim 8, wherein said upper polishing disk and said inner disk of said lower polishing disk are rotated in different directions, and said outer disk of said lower polishing disk and said inner disk are rotated in the same direction.

10. A ball polishing apparatus for polishing a ball, comprising:

at least two inner disks vertically spaced apart at a predetermined gap and arranged coaxial in a horizontal plane, each having a diameter greater than the immediate lower one; at least two annular outer disks, having different diameters and surrounding said inner disks and coaxial therewith, respectively, forming holding portions for holding the ball with inner circumferential portions thereof and outer circumferential portions of said inner disk;

magnetic holding means for holding said outer disk in a state in which said outer disk is movable with reference to said inner disk in an axial direction of said inner disk, said magnetic holding means including holding rings provided for lower surfaces of the respective outer disks and repulsive rings located in opposition to the respective holding rings, said holding rings and said repulsive rings being magnetized and arranged with their same-polarity portions facing each other, to thereby generate a magnetic repulsive force by which to hold said outer disk; and driving means for driving said inner and outer disks in predetermined directions, respectively.

11. A ball polishing apparatus for polishing a ball, comprising:

a driving shaft;

first driving means for driving said driving shaft;

a lower polishing disk having a holding portion formed on an upper surface thereof for rollably holding the ball, and a support shaft provided on a lower surface thereof;

coupling means for coupling said support shaft to said driving shaft, allowing said support shaft to move along an axis of said driving shaft and to swing away from the axis of said driving shaft, and making said support shaft rotate together with said driving shaft;

magnetic holding means for holding said lower polishing disk in a state where said outer disk is movable along said axis, said magnetic holding means including a first ring provided for a lower surface of said lower polishing disk and a second ring located in opposition to the first ring, said first ring and said second ring being magnetized and arranged with their same-polarity portions facing each other, to thereby generate a magnetic repulsive force by which to hold said lower polishing disk;

an upper polishing disk, arranged above said lower polishing disk and opposing said lower disk, for pushing the ball held by said holding portion with a predetermined load; and second driving means for driving said upper polishing disk.

12. An apparatus according to claim 11, wherein said coupling means comprises an insertion hole formed in an upper end face of said driving shaft and having a diameter larger than that of said support shaft, an engaging groove radially formed in an upper end portion of said driving shaft intersecting with the insertion hole, an a pin provided at a lower end portion of said support shaft and engaged in said engaging groove.

13. A ball polishing apparatus for polishing a ball, comprising:

a lower polishing disk, having an inner disk and an annular outer disk surrounding said inner disk and coaxial therewith, an outer circumferential portion of said inner disk and an inner circumferential portion of said outer disk forming a holding portion for rollably holding the ball;

positioning means for moving at least one of said outer and inner disks in an axial direction of said outer and inner disks and adjusting the positions of said outer and inner disks in a horizontal direction perpendicular to said axial direction;

first driving means for driving said lower polishing disk;

an upper polishing disk, arranged and opposed said lower polishing disk, for pushing the ball held by said holding portion; and second driving means for driving said upper polishing disk.

14. An apparatus according to claim 13, wherein said positioning means regulates a movement of said outer disk in a radial direction thereof and vertically moves at least one of said outer and inner disks.

15. A ball polishing apparatus for polishing a ball, comprising:

a lower polishing disk, having an inner disk and an annular outer disk surrounding said inner disk and coaxial therewith, an outer circumferential portion of said inner disk and an inner circumferential portion of said outer polishing disk forming a holding portion for rollably holding the ball;

holding means for moving said outer disk with reference to said inner disk in an axial direction of said inner disk and holding said inner and outer disks such that horizontal positions thereof are maintained in a predetermined state;

first driving means for driving said lower polishing disk;

an upper polishing disk, arranged and opposing said lower polishing disk, for pushing the ball held by said holding portion; and second driving means for driving said upper polishing disk.

* * * * *